United States Patent [19]

Poyer

[11] Patent Number: 4,692,848

[45] Date of Patent: Sep. 8, 1987

[54] OUTDOOR LIGHTING FIXTURE WITH U-SHAPED FLUORESCENT LAMP

[76] Inventor: David D. Poyer, 858 Roseway St., Naples, Fla. 33942

[21] Appl. No.: 885,674

[22] Filed: Jul. 15, 1986

[51] Int. Cl.[4] ..... F21S 5/00; F21V 21/00

[52] U.S. Cl. ..... 362/216; 362/267; 362/431

[58] Field of Search ..... 362/202, 216, 260, 267, 362/296, 311, 341, 362, 375, 431

[56] References Cited

U.S. PATENT DOCUMENTS

| | | | |
|---|---|---|---|
| 3,328,573 | 6/1967 | Nava et al. | 362/267 |
| 3,731,082 | 5/1973 | Blaylock | 362/216 X |
| 3,902,057 | 8/1975 | La Violette | 362/267 |
| 4,142,179 | 2/1979 | Lowndes | 362/267 X |
| 4,276,580 | 6/1981 | Rogers | 362/267 X |
| 4,380,793 | 4/1983 | Potts | 362/267 |
| 4,499,527 | 2/1985 | Tauber et al. | 362/267 |
| 4,523,263 | 6/1985 | Poyer | 362/267 |
| 4,564,890 | 1/1986 | Poyer | 362/216 |

*Primary Examiner*—Willis R. Wolfe, Jr.
*Attorney, Agent, or Firm*—Merrill N. Johnson

[57] ABSTRACT

An improved and simplified lighting fixture designed for rugged outdoor use and whose housing is made of polyvinyl chloride. The fixture's major components include a cylindrical housing of polyvinyl chloride having an annular ring projecting from the center of its inner wall; a U-shaped standard voltage fluorescent lamp; a socket for said lamp; a 120 volt transformer; a hollow cylindrical housing extension of polyvinyl chloride whose outer diameter is slightly less than the inner diameter of said housing and which is fitted into the lower end of said housing; a flanged circular base plate sized to fit snugly into the lower end of the housing extension and carrying on its upper surface the fluorescent lamp socket and the transformer; a dished reflector surrounding the lower end of the lamp and secured against the annular ring of said housing; and a flat circular transparent lens bonded to the upper end of said housing.

6 Claims, 3 Drawing Figures

OUTDOOR LIGHTING FIXTURE WITH U-SHAPED FLUORESCENT LAMP

BACKGROUND AND SUMMARY OF THE INVENTION

My invention relates to a simplified electric lighting fixture using a standard voltage U-shaped fluorescent lamp designed for outdoor use and constructed mainly of polyvinyl chloride resin.

Until recently, for various reasons, most electric lighting fixture housings and fittings have been made of metal. One reason is that metals do not deteriorate or deform as the result of the high temperatures generated within the fixture by incandescent 110-volt lamps used in conventional lighting fixtures. However, for lighting fixtures designed for use out-of-doors, most metal housings and fittings are subject to rapid corrosion due to constant exposure to rain and sun and, in coastal areas, to salt spray, even when the metal parts are temporarily protected by paint. Recent increases in the price of metals and in fabricating costs have resulted in increases in the prices of conventional lighting fixtures with housings and fittings made of metal.

The present trend to reduce energy consumption has resulted in increased use of low voltage lamps; that is, incandescent lamps which operate at voltages considerably less than 110 volts. These low voltage lamps, particularly 12-volt incandescent lamps, generate far less heat in operation than 110-volt lamps.

My prior U.S. Pat. No. 4,564,890 disclosed an outdoor lighting fixture using a standard voltage U-shaped fluorescent lamp having ten major components as follows: a cylindrical housing having at its center an interior annular ring made of high density polyvinyl chloride resin (hereinafter often referred to as PVC); a U-shaped fluorescent lamp; a socket for the lamp; a circular base supporting the socket having an outer diameter less than the inside diameter of the cylindrical housing; a 120-volt transformer mounted on the base: a retaining ring having an outer diameter less than the inside diameter of the housing; a closed-ended tubular transparent diffuser having a diameter somewhat less than the inner diameter of the housing; a pair of flexible O-rings for securing the diffuser to the housing; and a circular bushing of PVC for sealing the rear of the housing and containing an annular opening for the electric wires connected to energize the U-shaped fluorescent lamp.

As mentioned in my aforesaid prior patent, there are a number of prior suggestions in the art to use various plastic and elastomeric resins in the fabrication of lighting fixture components. These suggestions include U.S. Pat. Nos. 3,902,057; 4,210,841; 4,360,862; 4,379,321; 4,380,793; 4,414,613; 4,523,263 and 4,564,890.

However, my simplified outdoor lighting fixture using a standard voltage U-shaped fluorescent lamp possesses the following advantages over previous outdoor fixtures.

1. Because it comprises only a few components and these components are already manufactured in quantity, the cost of its components is lower than the cost of conventional fixture components.

2. Because of the simplicity of its components which can be quickly assembled by unskilled labor, my lighting fixtures costs less to manufacture than conventional fixtures.

3. Because of its simple cylindrical form, my lighting fixture is more rugged and easier to disassemble than conventional fixtures.

My improved and simplified outdoor lighting fixture includes the following components: a cylindrical housing having at its center an interior annular ring; a U-shaped fluorescent lamp; a 120 volt transformer; a hollow cylindrical housing extension; a flat circular base plate; a dish-shaped reflector, two cylindrical spacer rings whose outer diameters are slightly smaller than the inner diameter of the cylindrical housing; a flat circular lens, and an elastomeric compressible O-ring. All these components are used in vast quantities in other fields and hence are readily available at modest cost.

DETAILED DESCRIPTION OF A PREFERRED EMBODIMENT

Figure 1:
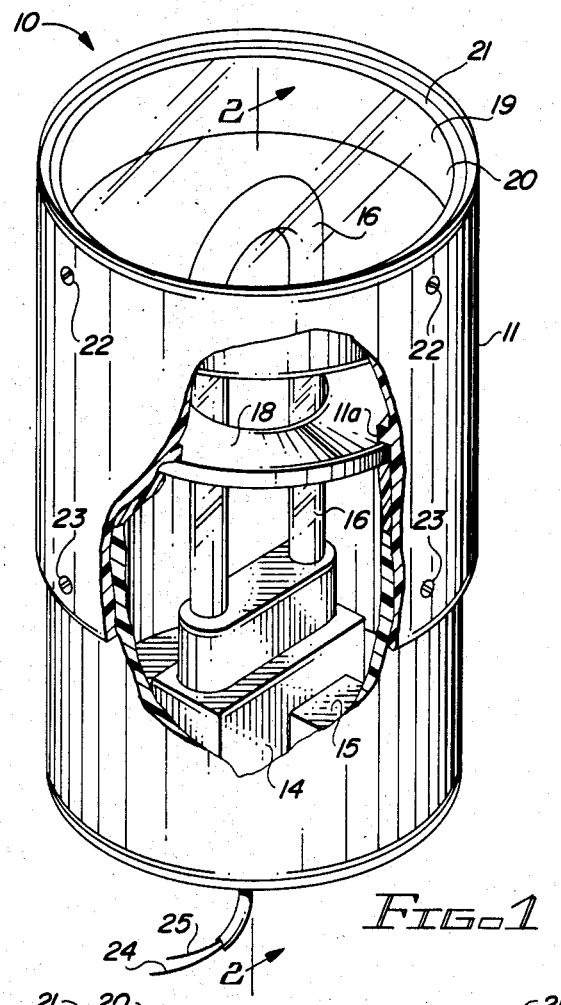
FIG. 1 is a perspective view of a preferred embodiment of my outdoor lighting fixture.
Figure 2:
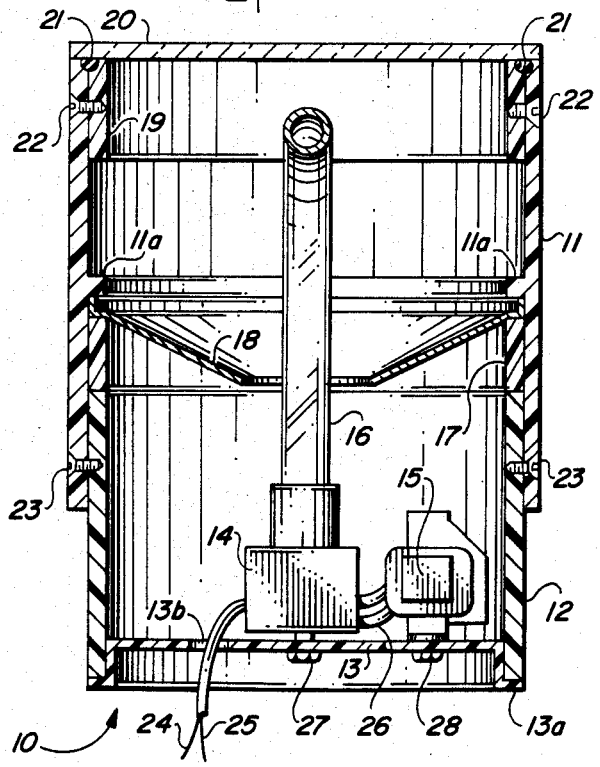
FIG. 2 is a cross-sectional side view partially broken away of my lighting fixture shown in FIG. 1 taken along line 2—2 which shows the details of the various components of the fixture and the manner of their assembly.
Figure 3:
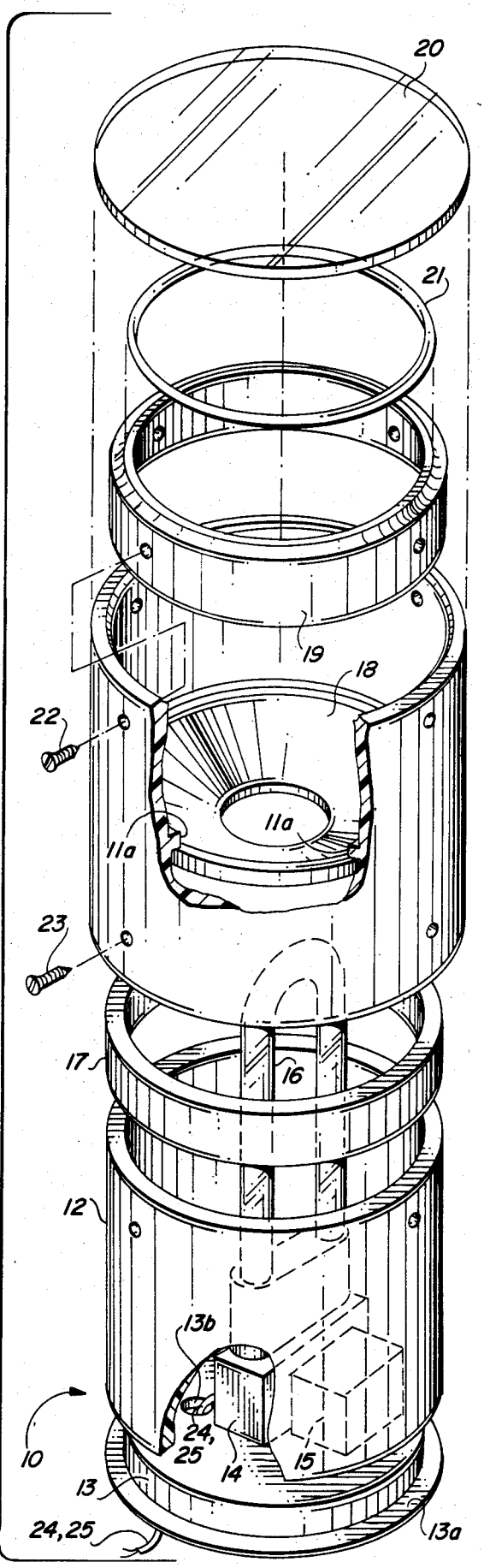
FIG. 3 is an exploded perspective view of the lighting fixture which is shown in FIGS. 1 and 2.

Referring to FIGS. 1 and 2, my assembled outdoor lighting fixture 10 includes a cylindrical housing 11 preferably made of high density polyvinyl chloride (PVC) having at its center a flat-edged ring 11*a* projecting from its inner surface. A hollow cylindrical housing extension 12 also made of PVC has an outside diameter just slightly less than the inner diameter of housing 11. Housing extension 12 is connected to the lower end of housing 11 by two diametrically opposite stainless steel screws 23 as best shown in FIG. 2.

A fluorescent lamp assembly is mounted on a flat circular base plate 13 preferably made of high impact styrene and having an outer flange 13*a* designed to fit snugly onto the lower end of housing extension 12. Base plate 13 may be permanently bonded to extension 12 by a suitable waterproof cement (not shown). A fluorescent lamp socket 14 and a 120 volt transformer 15 are mounted on base plate 13 by respectively a pair of screws 27 and a pair of bolts 28 as best shown in FIG. 2.

Fluorescent lamp 16 has a conventional U-shaped tube and a bayonet type base for insertion into socket 14. Transformer 15 and socket 14 are wired in series by insulated wires 24, 26, and 25 as shown in FIG. 2. Wires 24 and 25 extend outside fixture 10 through a hole 13*b* in base plate 13. Hole 13*b* may be sealed against moisture by a doughnut-shaped rubber gromet or other conventional means (not shown).

To increase the usable illumination provided by fixture 10, a mirror-surfaced dished reflector 18 surrounds the lower portion of lamp 16. As assembled, reflector 18 is held in place between flange 11*a* and preferably split spacer ring 17 which in turn rests upon the upper edge of housing extension 12.

The top of fixture 10 is sealed in place to keep water and moisture from electrical components of the fixture. A reinforcing ring 19 having an outside diameter just slightly smaller than the inner diameter of housing 11 is attached to the upper end of the housing by preferably four stainless steel screws 22. A semicircular groove is cut in the upper end of the housing and ring to accomodate an elastometic compressible O-ring 21. Lens 20 which may be clear or tinted plastic is securely bonded to the upper surface of housing 11 and ring 19 by waterproof cement or other means not shown.

Fluorescent lamp 16 and its socket and transformer are now securely sealed within fixture 10 against moisture and other corrosion causing elements. However, lamp 16 is readily accessible by unscrewing screws 23 and pulling housing 11 and extension 12 apart. Since the housing, housing extension, the base plate, the two rings and the lens are all made of PVC or other dense thermoplastic material, the fixture will not deteriorate, deform or corrode despite continuous exposure to sun, wind, rain and salt spray. Moreover, the simple cylindrical construction of my lighting fixture makes it extremely rugged and resistant to abuse.

To those skilled in the art it will be apparent that certain changes and modifications may be made, including changes made to adapt it to specific uses. Various mounting techniques may alter the construction of the rear end of the fixture. These and other modifications may be made without departing from the spirit of my invention whose scope is limited only by the appended claims.

I claim:

1. A fluorescent lighting fixture designed for outdoor use comprising:

a cylindrical housing of polyvinyl chloride and having an upper end, a lower end, generally concentric inner and outer walls, and an annular ring projecting inwardly from its inner walls;

a cylindrical housing extension made of polyvinyl chloride and having upper and lower ends, generally concentric inner and outer walls and an outer diameter slightly less than the inner diameter of the housing, said extension being fitted into the lower end of said housing;

a generally flat circular base plate made of thermoplastic material sized to fit snugly into the lower end of the housing extension;

a fluorescent lamp assembly consisting of a U-shaped fluorescent lamp, a socket for said lamp, and a 120 volt transformer wired in series, the socket and the transformer being mounted on the upper surface of said base plate;

a circular mirror-surfaced reflector surrounding the lower end of the fluorescent lamp and secured against the annular ring of said housing; and a flat circular transparent lens bonded to the upper end of said housing.

2. A fluorescent lighting fixture as set forth in claim 1 wherein a split spacer ring of polyvinyl chloride with an outside diameter the same as the housing extension has an upper end resting against the circular reflector and a lower edge resting on the upper end of the housing extension.

3. A fluorescent lighting fixture as set forth in claim 1 wherein the upper end of the housing contains a circular groove sized to accomodate a compressable O-ring.

4. A fluorescent lighting fixture as set forth in claim 3 wherein a reinforcing ring of polyvinyl chloride with the same outside diameter as the housing extension is affixed to the inside of the upper end of the housing and the upper ends of the housing and the reinforcing ring contain a circular groove sized to accomodate a compressable O-ring of elastomeric material and the circular lens is bonded to the upper end of the housing and reinforcing ring over the compressible O-ring.

5. A fluorescent lighting fixture designed for rugged use out of doors comprising;

a hollow cylindrical housing of thermoplastic material having an upper end, a lower end, concentric inner and outer walls, and an annular ring projecting inwardly from its inner wall;

a cylindrical housing extension of thermoplastic material having upper and lower ends, concentric inner and outer walls and an outer diameter slightly less than the inner diameter of the housing, the upper end of said extension being fitted into the lower end of the housing;

a flanged flat circular base plate of thermoplastic material sized to fit snugly into the lower end of the extension;

a fluorescent lamp assembly consisting of a U-shaped fluorescent lamp, a ceramic socket for said lamp, and a 120 volt transformer wired in series, the socket and the transformer being mounted onto the upper surface of said base plate;

a dished circular mirror-surfaced reflector surrounding the lower end of the fluorescent lamp and secured against the annular ring of said housing;

a reinforcing ring of thermoplastic material having an outside diameter the same as the housing extension affixed to the inside of the upper end of the housing; and a circular transparent lens bonded to the upper end of said housing and reinforcing ring.

6. A fluorescent lighting fixture as set forth in claim 5 wherein the upper ends of the housing and reinforcing ring contain a circular groove, and a compressible O-ring of elastomeric sized to fit into said circular groove is placed in the groove and the circular lens is bonded to the upper end of the housing and the reinforcing ring over said compressible O-ring.

* * * * *